US012029357B2

(12) United States Patent
Diethelm et al.

(10) Patent No.: US 12,029,357 B2
(45) Date of Patent: Jul. 9, 2024

(54) SECURING SYSTEM FOR SECURING A SANITARY ARTICLE

(71) Applicant: GEBERIT INTERNATIONAL AG, Jona (CH)

(72) Inventors: Alois Diethelm, Vorderthal (CH); Martin Niederberger, Uznach (CH); Juanes Braulio, Wetzikon (CH); Rolf Weiss, Grüningen (CH); Maurus Zwicker, Eschenbach (CH)

(73) Assignee: GEBERIT INTERNATIONAL AG, Jona (CH)

( * ) Notice: Subject to any disclaimer, the term of this patent is extended or adjusted under 35 U.S.C. 154(b) by 1016 days.

(21) Appl. No.: 16/965,532

(22) PCT Filed: Jan. 29, 2019

(86) PCT No.: PCT/EP2019/052129
§ 371 (c)(1),
(2) Date: Jul. 28, 2020

(87) PCT Pub. No.: WO2019/145567
PCT Pub. Date: Aug. 1, 2019

(65) Prior Publication Data

US 2021/0071403 A1 Mar. 11, 2021

(30) Foreign Application Priority Data

Jan. 29, 2018 (EP) ..... 18153793
Jan. 29, 2018 (EP) ..... 18153795
(Continued)

(51) Int. Cl.
*E03C 1/322* (2006.01)
*A47K 13/12* (2006.01)
(Continued)

(52) U.S. Cl.
CPC ..... *A47K 13/12* (2013.01); *E03C 1/322* (2013.01); *E03C 1/324* (2013.01); *E03D 11/125* (2013.01);
(Continued)

(58) Field of Classification Search
CPC ..... E03C 1/322; E03C 1/32; A47K 13/12
(Continued)

(56) References Cited

U.S. PATENT DOCUMENTS 906,247 A * 12/1908 Mahoney ..... E03C 1/322
2,584,107 A 2/1952 Beam
(Continued)

FOREIGN PATENT DOCUMENTS

CN 103502543 A 1/2014
DE 1 937 520 A1 1/1970
(Continued)

OTHER PUBLICATIONS

Office Action issued Aug. 2, 2022 in Japanese Application No. 2020-562849.
(Continued)

*Primary Examiner* — Huyen D Le
(74) *Attorney, Agent, or Firm* — Sughrue Mion, PLLC

(57) ABSTRACT

A fastening system for the fastening of a sanitary article comprising a carrier element, at least one upper stop portion which lies on the carrier element and which strikes against an upper stop of the sanitary article, at least one lower stop portion which lies on the carrier element and which strikes against a lower stop of the sanitary article, and at least one clamping element. At least one of the stop portions is mounted on the carrier element so as to be displaceable with respect to the carrier element, and is connected to the at least one clamping element in such a way that, as a result of actuation of the clamping element, the stop portion can be
(Continued)

displaced in a direction of actuation such that the two stop portions can be braced between the two stops of the sanitary article.

17 Claims, 5 Drawing Sheets

(30) Foreign Application Priority Data

Jan. 29, 2018 (EP) ..... 18153796
Jan. 29, 2018 (EP) ..... 18153797

(51) Int. Cl.
*E03C 1/324* (2006.01)
*E03D 11/12* (2006.01)
*E03D 11/14* (2006.01)
*E03D 11/16* (2006.01)
*E03D 11/17* (2006.01)

(52) U.S. Cl.
CPC ..... *E03D 11/143* (2013.01); *E03D 11/16* (2013.01); *E03D 11/17* (2013.01)

(58) Field of Classification Search
USPC ..... 4/648; 292/256
See application file for complete search history.

(56) References Cited

U.S. PATENT DOCUMENTS 3,364,503 A * 1/1968 Mustee ..... E03C 1/322 248/301
3,975,781 A * 8/1976 Klimboff ..... A47K 1/04 4/340
4,979,239 A * 12/1990 Klein ..... A47K 1/04 4/252.3
2021/0047821 A1* 2/2021 Diethelm ..... E03D 11/16

FOREIGN PATENT DOCUMENTS

| | | | |
|---|---|---|---|
| DE | 201 11 959 | U1 | 11/2001 |
| DE | 10 2011 052 558 | A1 | 2/2013 |
| GB | 1 228 375 | A | 4/1971 |
| JP | 2-120574 | U | 9/1990 |
| JP | 7-305398 | A | 11/1995 |
| JP | 7-317127 | A | 12/1995 |
| JP | 2013-2153 | A | 1/2013 |
| JP | 2016-176268 | A | 10/2016 |
| KR | 20-2010-0006608 | U | 6/2010 |
| WO | 03/008719 | A1 | 1/2003 |

OTHER PUBLICATIONS

International Search Report for PCT/EP2019/052129 dated Apr. 23, 2019 (PCT/ISA/210).

* cited by examiner

SECURING SYSTEM FOR SECURING A SANITARY ARTICLE

CROSS REFERENCE TO RELATED APPLICATIONS

This application is a National Stage of International Application No. PCT/EP2019/052129 filed Jan. 29, 2019, claiming priority based on European Patent Application No. 18 153 795.2, filed Jan. 29, 2018, European Patent Application No. 18 153 796.0, filed Jan. 29, 2018, European Patent Application No. 18 153 797.8, filed Jan. 29, 2018, and European Patent Application No. 18 153 793.7, filed Jan. 29, 2018.

TECHNICAL FIELD

The present invention relates to a fastening system for the fastening of a sanitary article according to the preamble of claim 1.

PRIOR ART

DE 10 2011 052 558 has disclosed a fastening apparatus for the fastening of a toilet bowl. The fastening apparatus engages with pins into openings which are arranged in side walls on the toilet bowl. A disadvantage of DE 10 2011 052 558 is the bracing of the fastening apparatus by way of the side walls and the associated introduction of force from the loaded toilet bowl into the fastening apparatus.

SUMMARY OF THE INVENTION

Starting from said prior art, an object on which the present invention is based is to specify a fastening system for a sanitary article, such as a toilet bowl or a wash basin, which system overcomes the disadvantages of the prior art. In particular, the intention is to specify a fastening apparatus which permits an improved introduction of force from the sanitary article into the fastening system.

Said object is achieved by the subject matter of claim 1. Accordingly, a fastening system for the fastening of a sanitary article comprises a carrier element with at least one fastening receptacle which can be connected to a fastening means arranged in a fixed manner on site, at least one upper stop portion which lies on the carrier element and which strikes against an upper stop of the sanitary article, at least one lower stop portion which lies on the carrier element and which strikes against a lower stop of the sanitary article, and at least one clamping element. In the installation position, the upper stop portion lies above the lower stop portion. At least one of the stop portions is mounted on the carrier element so as to be displaceable with respect to the carrier element, and is connected to the at least one clamping element in such a way that, as a result of actuation of the clamping element, said stop portion can be displaced in a direction of actuation in such a way that the two stop portions can be braced between the two stops of the sanitary article.

The spatial arrangement of the two stop portions above one another affords the advantage that the gravitationally acting forces, which arise on account of the net weight of the sanitary article or as a result of use of same, are satisfactorily introduced into the carrier element and thus into the fastening means which are arranged in a fixed manner on site.

The term "above" is to be understood such that, in the installation position, the upper stop portion lies above the lower stop portion with respect to the direction of gravity. In other words, the two stop portions are arranged above one another, as seen in the vertical, and at a mutual spacing. Equally, the term "below" is to be understood such that, in the installation position, the lower stop portion lies below the upper stop portion with respect to the direction of gravity.

The wording that the stop portions lie on the carrier element is to be understood such that the stop portions are provided either by the carrier element itself, or that the stop portions are provided by a further element which can be fixedly or movably connected to the carrier element. Such a further element can for example be the stop element described below.

Preferably, the upper stop portion and the lower stop portion lie directly above one another with respect to a vertically oriented axis.

Preferably, the direction of actuation runs in the vertical or in the direction of gravity in the installation position.

Preferably, the at least one upper stop portion and the at least one lower stop portion each have a stop receptacle, into which the stops of the sanitary article protrude.

Particularly preferably, the stop receptacle of the upper stop portion is configured in such a way that a weight force can be introduced into the carrier element by way of said receptacle. The stop receptacle of the upper stop portion is preferably configured in such a way that the sanitary article can be hooked into the stop receptacle.

Particularly preferably, the stop receptacle is configured in such a way that a form fit is provided between the stop receptacle and the sanitary article when the two stop portions are braced between the two stops.

Particularly preferably, the two stop receptacles are of dovetail form, as seen transversely with respect to the direction of actuation. Preferably, the stops on the sanitary article are also of dovetail form. In this way, a good form fit can be achieved, with a good introduction of force being made possible at the same time.

Preferably, the at least one upper stop portion and the at least one lower stop portion each have an angularly inclined stop surface, wherein the angularly inclined stop surface is preferably part of the stop receptacle. In this case, the stop surface is in particular configured such that it is inclined at an angle with respect to the vertical.

Preferably, the at least one upper stop portion and the at least one lower stop portion each have a bearing surface which is oriented in the vertical, wherein the bearing surface which is oriented in the vertical is preferably part of the stop receptacle.

Particularly preferably, the angularly inclined stop surface is adjoined directly by the bearing surface. A kind of V-shaped receptacle is thus created. The sanitary article can likewise stand on the bearing surface, with it being possible for the upper stop portion, in particular, to absorb a horizontally acting force component.

Preferably, at least one of the stop portions is arranged on the carrier element in a positionally fixed manner. That is to say, said at least one stop portion cannot be displaced with respect to the carrier element.

Particularly preferably, at least one respective positionally fixedly arranged stop portion and at least one respective displaceably arranged stop portion are arranged, said two stop portions forming a stop pair. Preferably, two stop pairs are arranged, the stop pairs lying at a mutual spacing in a direction which is transverse to the vertical or transverse to the direction of actuation.

Preferably, the upper stop portion is provided by an upper stop element which can be connected to the carrier element, and/or the lower stop portion is provided by a lower stop element which can be connected to the carrier element.

Preferably, the upper stop element is fixedly connected to the carrier element by way of a mechanical connection, wherein the mechanical connection is preferably a latching connection or a snap-fit connection. Preferably, the lower stop element is fixedly connected to the carrier element by way of a mechanical connection, wherein the mechanical connection is preferably a latching connection or a snap-fit connection.

The stop element is preferably produced from a plastic or rubber, which has the advantage that good contacting of the sanitary article is achieved, particularly if the sanitary article is made of ceramic.

Preferably, the stop element, which provides the displaceable stop portion, has a receptacle for the clamping element, wherein, when the clamping element is actuated, the stop element can be displaced with the stop portion, in particular as a whole, relative to the carrier element.

Preferably, said stop element is mounted on a bar-like extension of the carrier element, said extension being oriented in the direction of actuation, wherein the clamping element preferably acts on an end surface which is arranged on the extension. As a result of actuation of the clamping element, the stop element can be displaced with the relative to the carrier element.

Particularly preferably, the actuating element is an adjusting screw which is mounted in a thread in said stop elements in a rotatable manner.

Preferably, the carrier element comprises a crossmember portion and at least one support portion which projects from the crossmember portion, wherein a respective upper and a respective lower stop portion are present on the support portion, and wherein the support portion and/or the crossmember portion have/has receiving structures for receiving at least one functional element.

The functional element can for example be a bearing structure for the conduction of water lines, such as a fresh water or waste water line, or threaded elements for the fastening of additional elements, such as a toilet lid, a fitting or a toilet seat ring or the like. The bearing structure can be mounted in the receiving structure in a movable manner.

An arrangement comprises a sanitary article having an upper stop and a lower stop, and a fastening system as described above, wherein the upper stop portion can be brought into contact with the upper stop and the lower stop portion can be brought into contact with the lower stop, and the two stop portions can be braced between the two stops.

Further preferred embodiments of the arrangement are characterized,

- in that the fastening system is arranged in a receiving space of the sanitary article; and/or
- in that the sanitary article has an access opening, by way of which the clamping element is accessible with a tool or without a tool; and/or
- in that the stops, with respect to the form thereof, are configured to have a complementary fit with the stop portions.

Further embodiments are indicated in the dependent claims.

BRIEF DESCRIPTION OF THE DRAWINGS

Preferred embodiments of the invention are described below with reference to the drawings, which serve merely for elucidation and are not to be interpreted as limiting. In the drawings:

FIGS. 2*a*/2*b* show sectional illustrations through the fastening system according to FIG. 1; wherein

DESCRIPTION OF PREFERRED EMBODIMENTS

Figure 1:
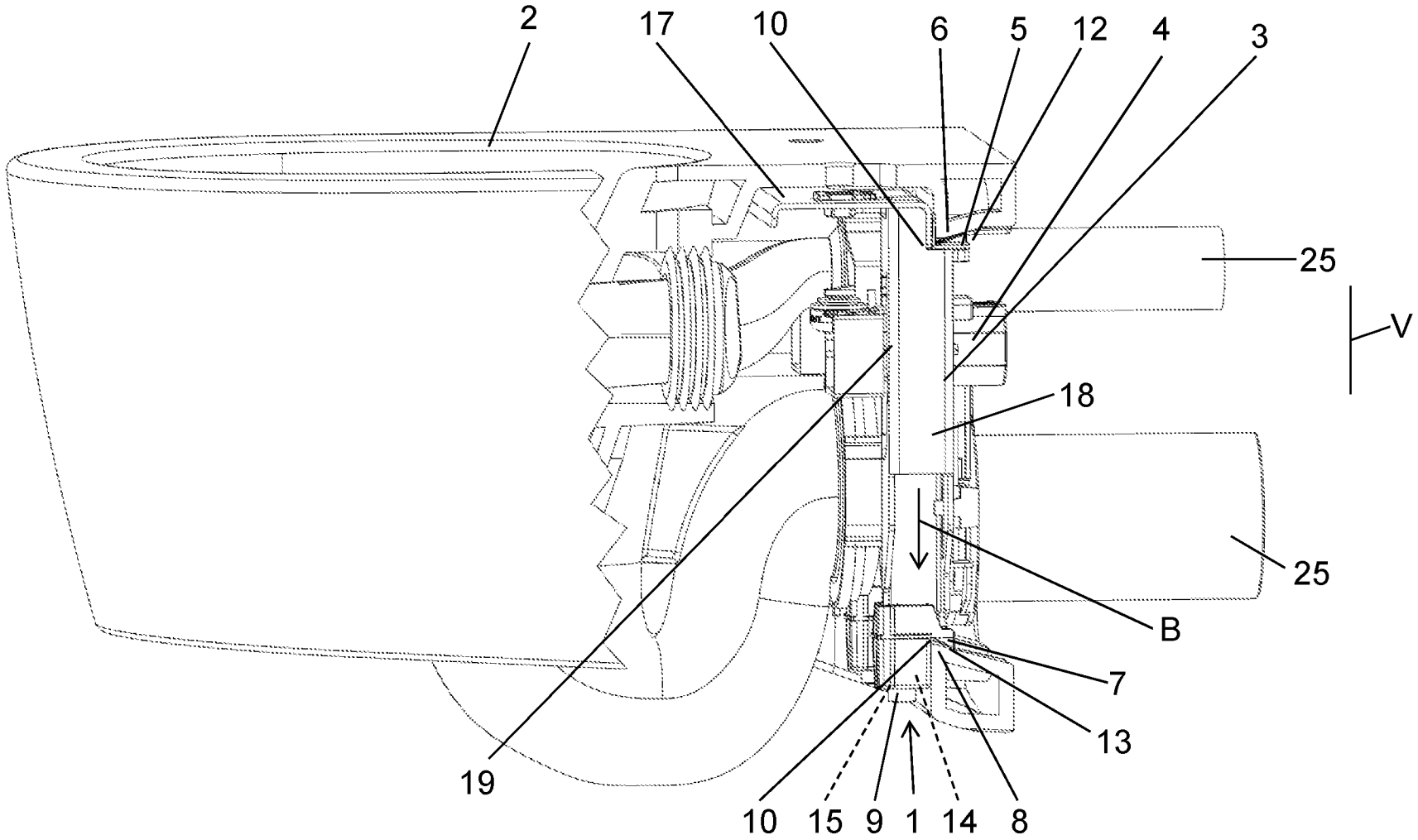
FIG. 1 shows a perspective sectional illustration of a fastening system according to one embodiment of the present invention.

FIG. 1 shows a perspective view of a fastening system 1 with a sanitary article 2. Here, the sanitary article 2 has the form of a toilet bowl. However, the sanitary article 2 can also be a wash basin, a sink, a urinal or a bidet. The sanitary article 2 is preferably made of ceramic; however, it can also be made of another material.

The fastening system 1 comprises a carrier element 3 with at least one fastening receptacle 4 which can be connected to a fastening means arranged in a fixed manner on site, at least one upper stop portion 5 which lies on the carrier element 3 and which strikes against an upper stop 6 of the sanitary article 2, at least one lower stop portion 7 which lies on the carrier element 3 and which strikes against a lower stop 8 of the sanitary article 2, and at least one clamping element 9. As shown in FIG. 1, the upper stop portion 5 lies above the lower stop portion 7, as seen in the installation position or in the vertical V. That is to say, the stop portions 5, 7 are arranged at a mutual spacing substantially in the vertical.

At least one of the stop portions 5, 7 is mounted on the carrier element 3 so as to be displaceable with respect to the carrier element 3. In the embodiment shown, it is the lower stop portion 7. The upper stop portion 5 is arranged fixedly with respect to the carrier element 3.

The displaceable stop portion 7 is connected to the at least one clamping element 9 in such a way that, as a result of actuation of the clamping element 9, said stop portion 7 can be displaced in a direction of actuation B in such a way that the two stop portions 5, 7 can be braced between the two stops 6, 8 of the sanitary article 2. By way of said ability to be braced, the carrier element 3 is fixedly assembled in the sanitary article 2. As a result of the connection of the carrier element 3, by way of the fastening receptacle 4 thereof, to the fastening means arranged on site, the sanitary article can be fixedly connected to a building. The fastening means arranged on site is not shown in the figures and can be a threaded rod which projects from a wall, for example.

In the embodiment shown, a respective upper stop portion 5 and a respective lower stop portion 7 form a stop pair. As is evident from FIG. 3, two pairs of the upper stop portion 5 and stop portion 7 are arranged at a mutual spacing. Said two pairs of stop portions 5, 7 are in this case able to be struck with corresponding stop pairings 6, 8. As shown by FIG. 1, the clamping element 9 is accessible from below. In this case, the clamping element 9 can be correspondingly actuated.

The direction of actuation B runs in the vertical V in the installation position. That is to say, the stop portion 5, 7 which is displaceably arranged on the carrier element 3 can be displaced in the direction of the vertical V in the installation position.

Figure 2B:
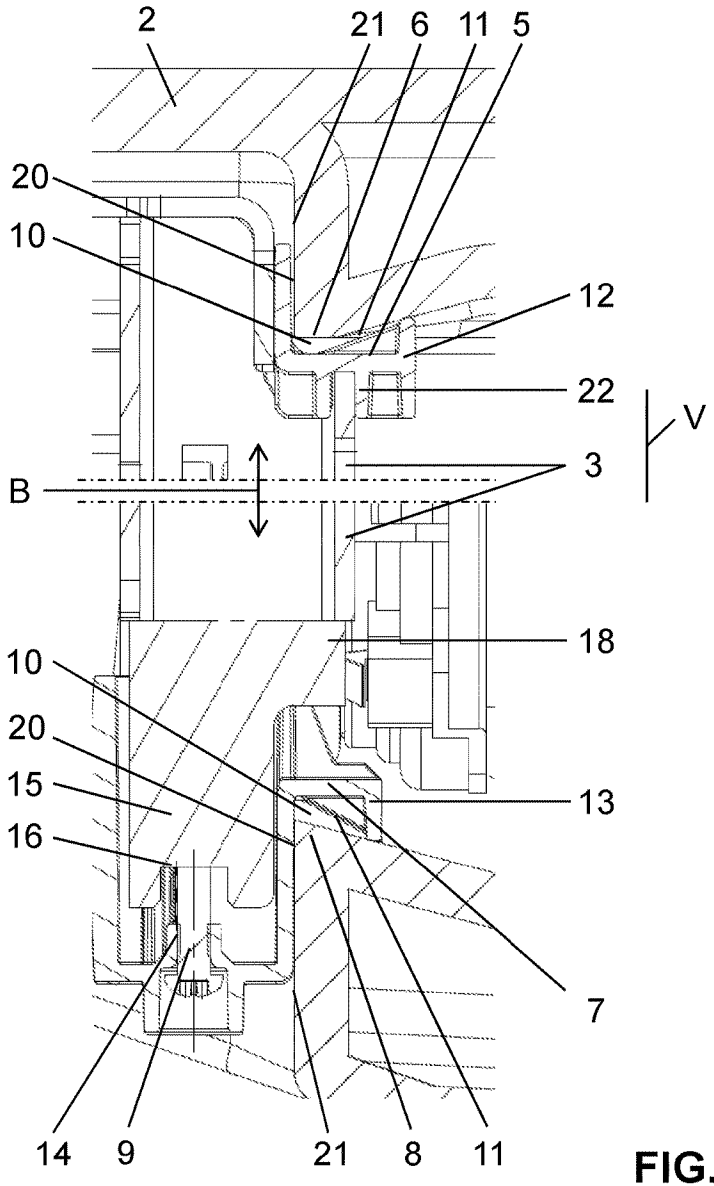
FIG. 2*b* shows detail views of FIG. 2*a;*
Figure 2A:
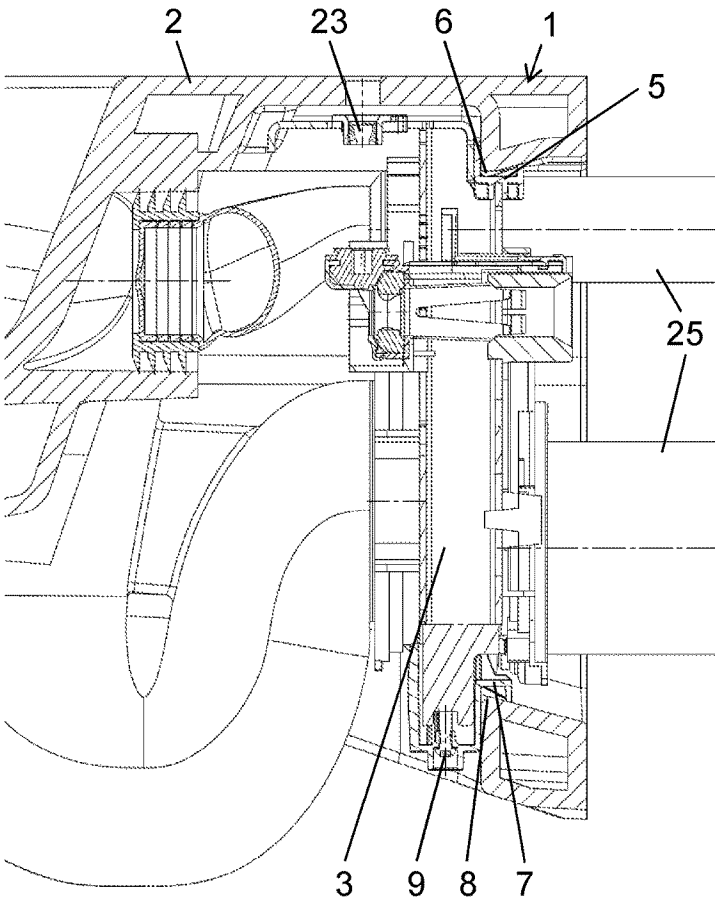

FIGS. 2*a* and 2*b* show sectional illustrations in the direction of the vertical V. It can be readily recognized from the detail illustrations of FIG. 2*b* that the upper stop portion 5 and the lower stop portion 7 each have a stop receptacle 10, into which the stops 6, 8 of the sanitary article 2 protrude. The stop receptacle 10 is in this case configured in such a way that, in the braced state, a form fit can be provided between the stop portions 5, 7 and the stops 6, 8.

As seen in cross section, the two stop receptacles 10 of the respective stop portion 5, 7 form a kind of dovetail structure, with the stops 6, 8 of the sanitary article 2 being configured in an opposing, mating manner. As a result of said dovetail-like structure, it is possible to provide a good mechanical connection between the stop portions 5, 7 and the stops 6, 8.

In general terms, the stop receptacle 10 is configured in such a way that a form fit is provided between the stop receptacle 10 and the stops 6, 8 of the sanitary article 2 when the two stop portions 5, 7 are braced between the two stops 6, 8. The form fit makes it possible to achieve a particularly good connection.

In the embodiment shown, both the upper stop portion 5 and the lower stop portion 7 have a respective stop surface 11 which is inclined at an angle with respect to the vertical V. Equally, the stops 6, 7 of the sanitary article 2 are configured to be inclined at an angle. The angle with respect to the vertical is configured to be substantially the same for the stop surfaces 11 and for the stops 6, 8. Further, the stop surface 11 which is arranged in an angularly inclined manner is adjoined, toward the front, by a bearing surface 20 which is oriented in the vertical V. The bearing surface 20 is used in this case as a further delimitation of the stop receptacle 10. The sanitary article 2 can correspondingly strike against the bearing surface 20 with a correspondingly configured bearing surface 21.

In the embodiment shown, the upper stop portion 5 is arranged on the carrier element 3 in a positionally fixed manner. That is to say, the stop portion 5 is placed or arranged on the carrier element 3 such that it cannot move with respect to the carrier element 3. Further, the lower stop portion 7 is arranged in a movable manner. That is to say that, in the embodiment shown, the positionally fixedly arranged stop portion 5 and the displaceably arranged stop portion 7 in each case form a stop pair.

Figure 4:
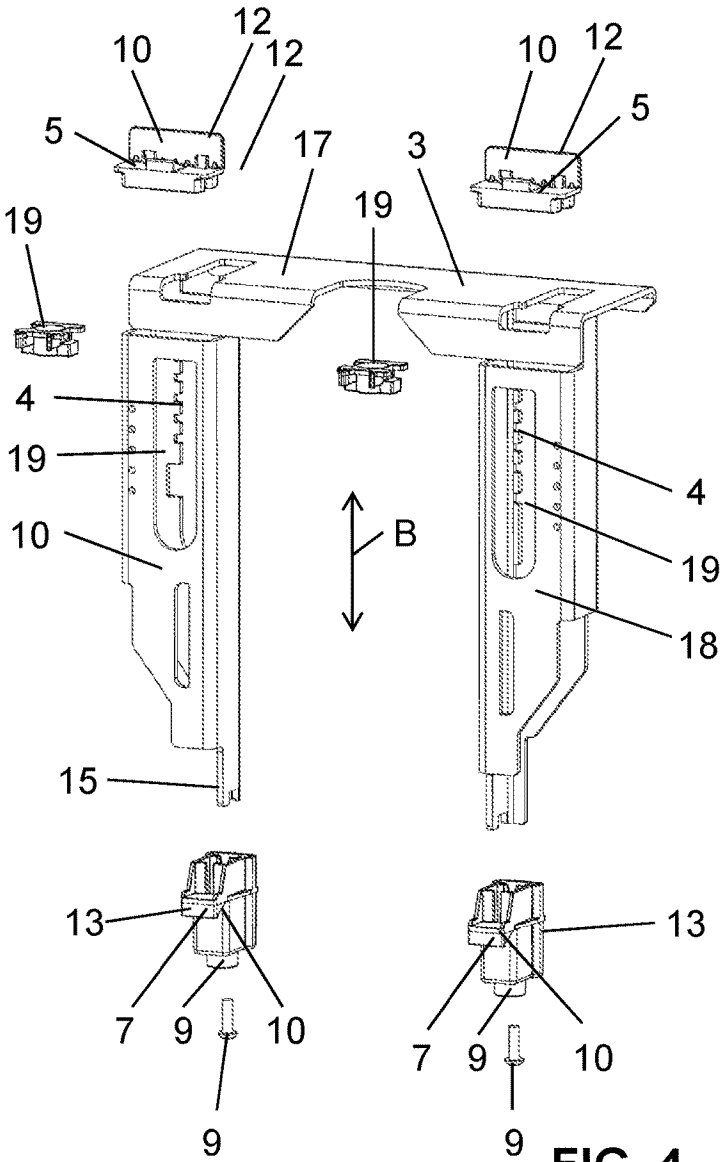
FIG. 4 shows a perspective exploded view of the fastening system according to FIG. 1.
Figure 3:
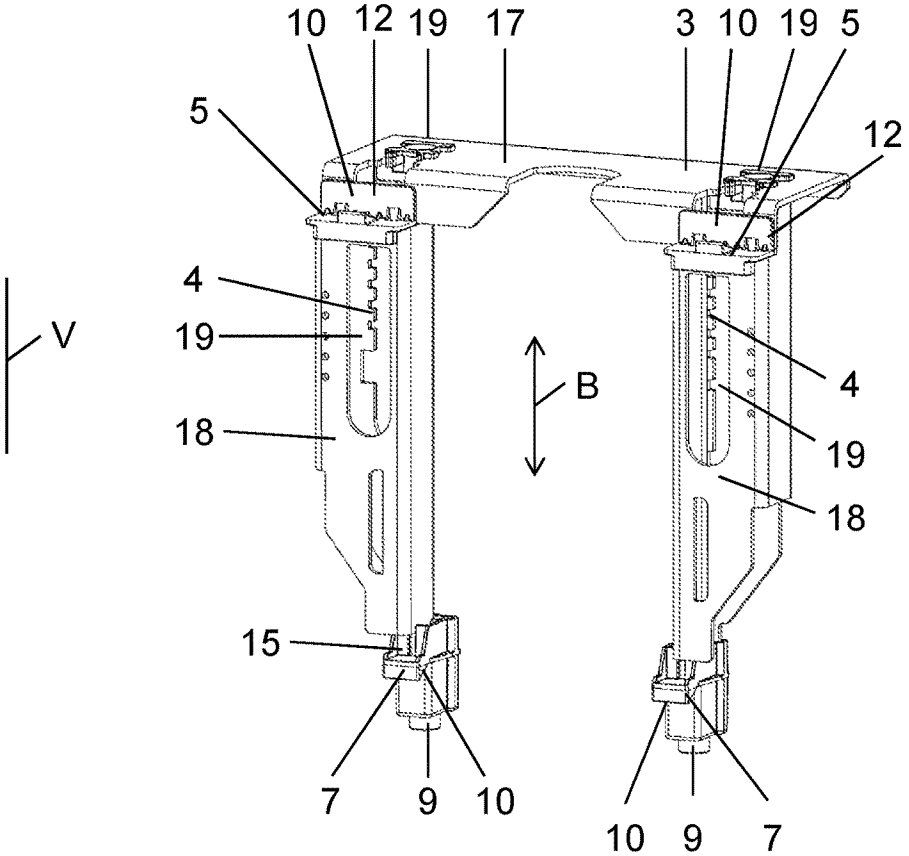
FIG. 3 shows a perspective view of the fastening system according to FIG. 1.

FIG. 3 shows a perspective arrangement of the carrier element with the stop portions 5, 7. FIG. 4 shows a similar illustration, with FIG. 4 being an exploded view.

It can be readily recognized from FIG. 4 that the upper stop portion is provided by an upper stop element 12, and the lower stop portion 7 is provided by a lower stop element 13. The two stop elements 12, 13 are in this case configured separately from the carrier element and can be connected to the carrier element 3. The upper stop element 12 is fixedly connected to the carrier element 3, while the lower stop element 13 is connected to the carrier element 3 in such a way that the stop portion 7, as mentioned above, can be displaced with respect to the carrier element 3. The upper stop element 12 is fixedly connected to the carrier element 3 by way of a mechanical connection. Preferably, the mechanical connection is a latching connection or a snap-fit connection.

The lower stop element 13, which provides the displaceable stop portion 7, has a receptacle 14 for the clamping element 9. When the clamping element 9 is actuated, the stop element 13 is displaced with the stop portion 7, as a whole, relative to the carrier element 3. In the embodiment shown, the stop element 3 is mounted on a bar-like extension 15 of the carrier element 3, said extension being oriented in the direction of actuation B. The clamping element 9 acts on an end surface 16 which is arranged on the extension 15, and, when the clamping element 9 is actuated, the stop element 13 is displaced on the extension 15 of the carrier element 3. In the embodiment shown, the clamping element 9 is an adjusting screw which is mounted in a thread in the stop element 13 in a rotatable manner. During a rotation, the end side of the adjusting screw is displaced. The adjusting screw can be readily recognized in FIG. 2*b*.

Figure 6:
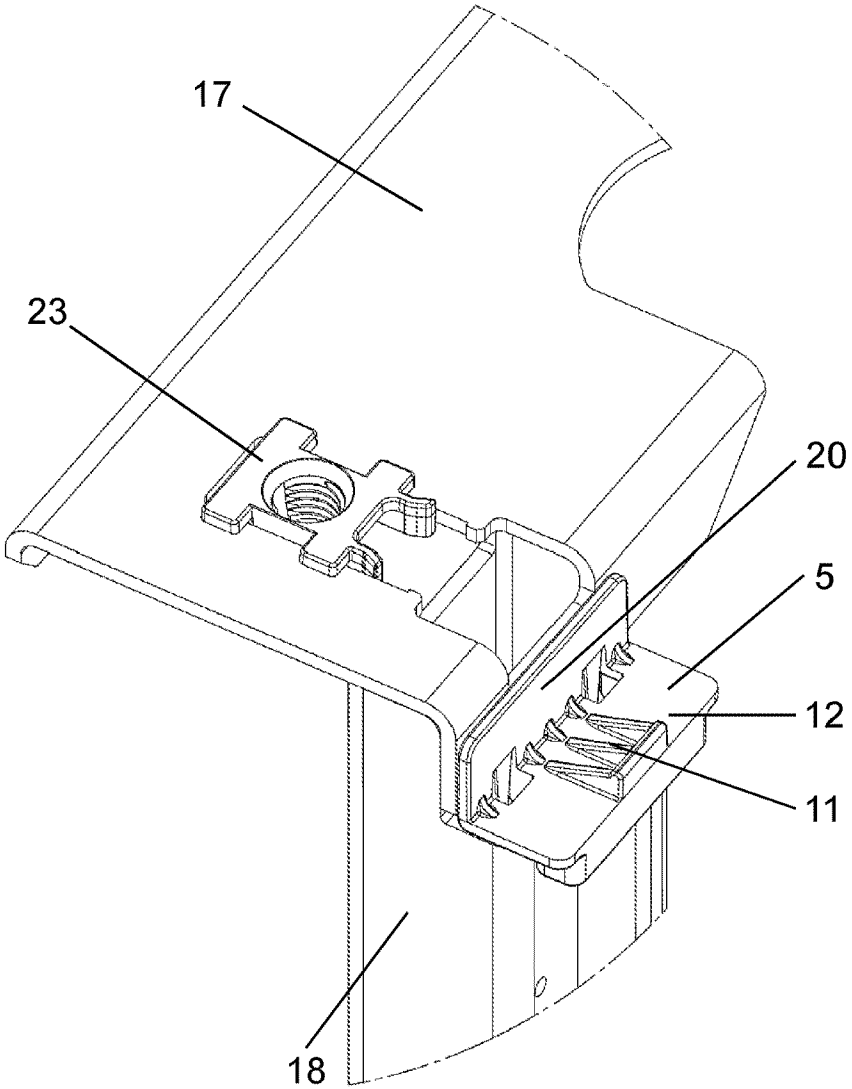
FIG. 6 shows a further detail view of an upper region of the fastening system according to FIG. 1.
Figure 5:
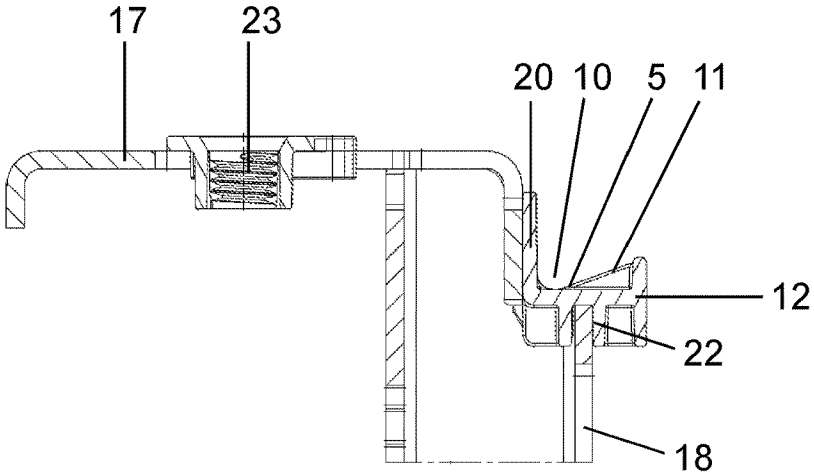
FIG. 5 shows a detail view of an upper region of the fastening system according to FIG. 1.

FIGS. 5 and 6 further show the specific embodiment of the upper stop element 12.

Here, it can be readily recognized that the stop element 12 has a receptacle 22 on its underside, into which parts of the carrier element 3 extend. Further, the stop surface 11, which is provided here by a plurality of webs, can be readily recognized in FIG. 6.

In addition, it can be recognized in FIG. 6 that the carrier element 3 has a crossmember portion 17, with the crossmember portion 17 comprising a receiving structure 19 here. In the receiving structure 19, a fastening element 23 which is provided with a thread and is intended for the fastening of an external element, such as, for example, a fitting or a toilet lid, is shown.

Figure 8:
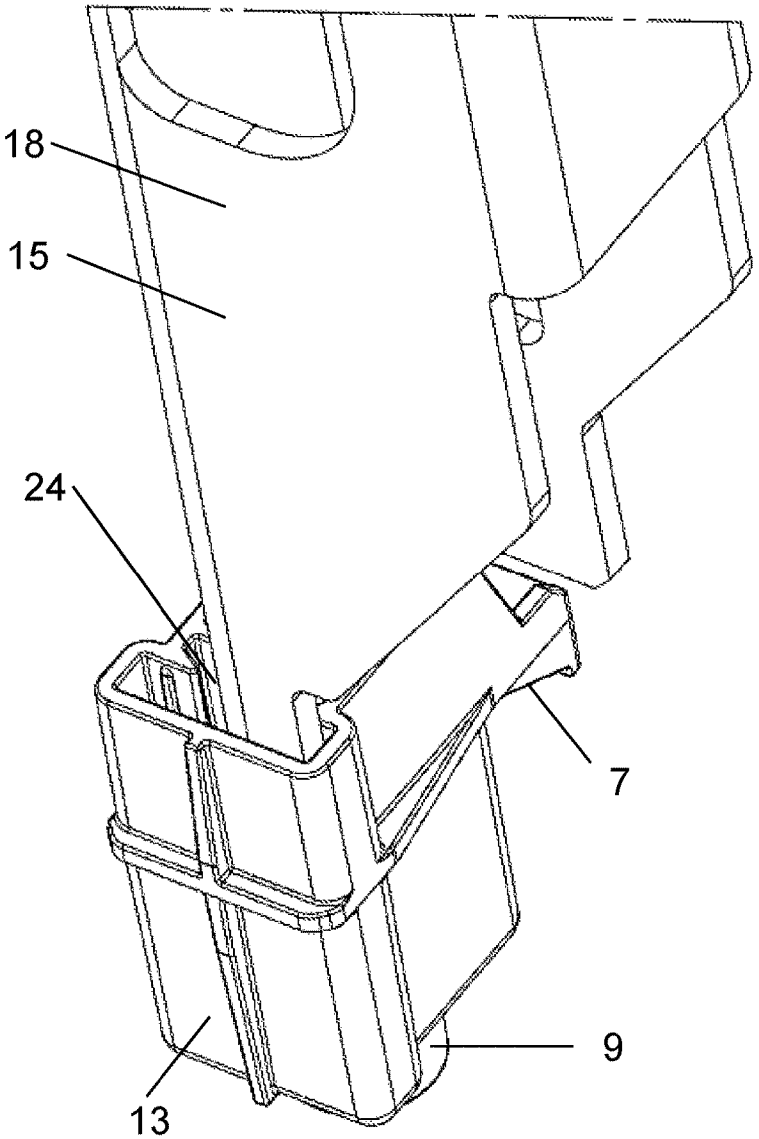
FIG. 8 shows a further detail view of a lower region of the fastening system according to FIG. 1.
Figure 7:
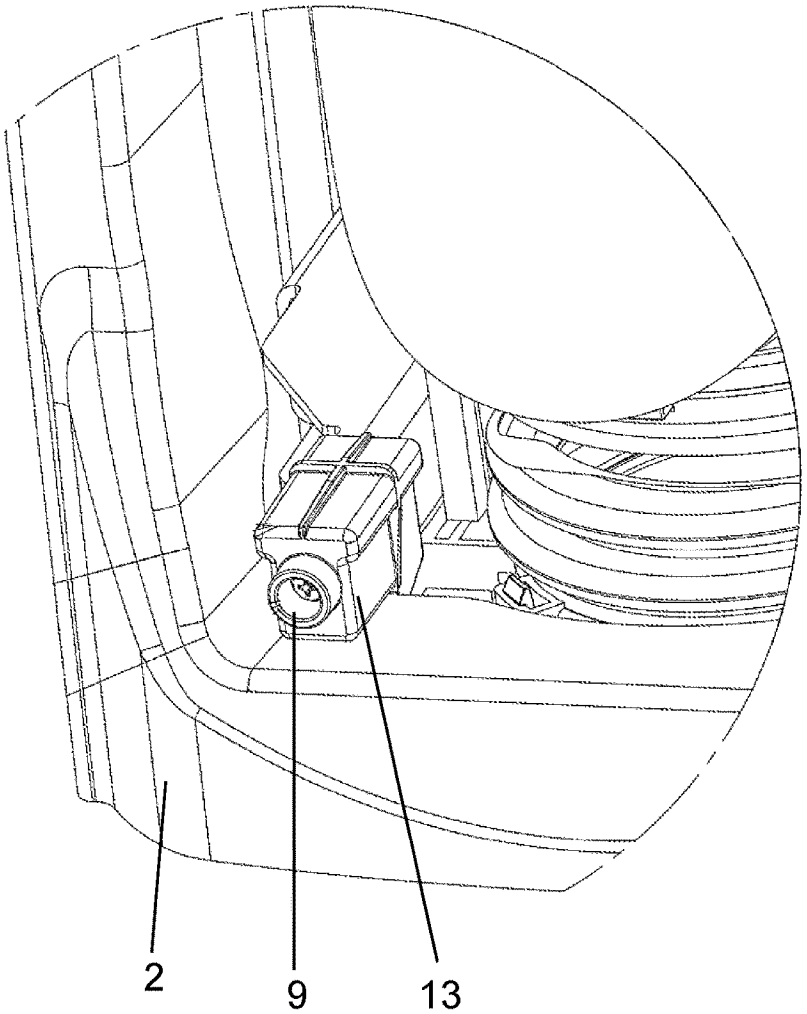
FIG. 7 shows a detail view of a lower region of the fastening system according to FIG. 1.

FIGS. 7 and 8 then show the detail view of the lower stop element 13. The lower stop element 13, as mentioned, bears against an extension 15. For this purpose, the lower stop element 13 has a guide opening 24 into which the extension 15 can protrude. The extension 15 is in this case part of the carrier element 3 and here forms the end of a support portion 18 which projects from the crossmember portion 17. In the embodiment shown, two support portions 18 which lie at a mutual spacing project from the crossmember portion 17.

The support portions 18 can likewise have receiving structures 19 for further elements. In the embodiment shown, the support portions 18 have slot-like receiving structures 19, which are used to receive further elements. By way of said receiving structure 19, the carrier element 3 can for example be connected to the fastening means which are arranged in a positionally fixed manner on site. The receiving structure 19 can provide the fastening receptacle 4, for example. The receiving structure 19 can also be used to mount lines 25, which are led through between the two support portions 18, for example.

In the embodiment shown, the support portions 18 extend in the direction of the actuating movement B and thus in the direction of the vertical V, as seen in the installation position.

The crossmember portion 17 and also the support portions 18 are preferably produced from metal profiles. In the embodiment shown, the stop elements 12, 13 are in each case mounted on the support portions.

| LIST OF REFERENCE SIGNS | |
|---|---|
| 1 | Fastening system |
| 2 | Sanitary article |
| 3 | Carrier element |

-continued

| LIST OF REFERENCE SIGNS | |
|---|---|
| 4 | Fastening receptacle |
| 5 | Upper stop portion |
| 6 | Upper stop |
| 7 | Lower stop portion |
| 8 | Lower stop |
| 9 | Clamping element |
| 10 | Stop receptacle |
| 11 | Stop surface |
| 12 | Upper stop element |
| 13 | Lower stop element |
| 14 | Receptacle |
| 15 | Extension |
| 16 | End surface |
| 17 | Crossmember portion |
| 18 | Support portion |
| 19 | Receiving structures |
| 20 | Bearing surface |
| 21 | Bearing surface |
| 22 | Receptacle |
| 23 | Fastening element |
| 24 | Guide opening |
| 25 | Lines |
| B | Direction of actuation |
| V | Vertical |

The invention claimed is:

1. A fastening system for the fastening of a sanitary article comprising:

a carrier element with at least one fastening receptacle which can be connected to a fastening means arranged in a fixed manner on site, at least one upper stop portion which lies on the carrier element and which strikes against an upper stop of the sanitary article, at least one lower stop portion which lies on the carrier element and which strikes against a lower stop of the sanitary article, and at least one clamping element, wherein, in the installation position, the upper stop portion lies above the lower stop portion, and wherein at least one of the stop portions is mounted on the carrier element so as to be displaceable with respect to the carrier element, and is connected to the at least one clamping element in such a way that, as a result of actuation of the clamping element, said stop portion can be displaced in a direction of actuation in such a way that the two stop portions can be braced between the two stops of the sanitary article.

2. The fastening system according to claim 1, wherein the sanitary article is a toilet bowl or a wash basin.

3. The fastening system as claimed in claim 1, wherein the direction of actuation runs in the vertical in the installation position.

4. The fastening system as claimed in claim 1, wherein the at least one upper stop portion and the at least one lower stop portion each have a stop receptacle, into which the stops of the sanitary article protrude.

5. The fastening system as claimed in claim 4, wherein the stop receptacle is configured in such a way that a form fit is provided between the stop receptacle and the sanitary article when the two stop portions are braced between the two stops.

6. The fastening system as claimed in claim 4, wherein the two stop receptacles are of dovetail form, as seen transversely with respect to the direction of actuation.

7. The fastening system as claimed in claim 4, wherein the stop receptacle is configured in such a way that a form fit is provided between the stop receptacle and the sanitary article when the two stop portions are braced between the two stops, and wherein the two stop receptacles are of dovetail form, as seen transversely with respect to the direction of actuation.

8. The fastening system as claimed in claim 4, wherein the at least one upper stop portion and the at least one lower stop portion each have a stop surface which is inclined at an angle with respect to the vertical, wherein the angularly inclined stop surface is part of the stop receptacle, and/or wherein the at least one upper stop portion and the at least one lower stop portion each have a bearing surface which is oriented in the vertical, wherein the bearing surface which is oriented in the vertical is part of the stop receptacle.

9. The fastening system as claimed in claim 1, wherein at least one of the stop portions is arranged on the carrier element in a positionally fixed manner or is arranged on the carrier element such that it cannot move with respect to the carrier element, and wherein the positionally fixed stop portion is the upper stop portion.

10. The fastening system as claimed in claim 9, wherein a respective positionally fixedly arranged stop portion and a respective displaceably arranged stop portion in each case form a stop pair, and wherein two stop pairs which are arranged at a mutual spacing are arranged on the carrier element.

11. The fastening system as claimed in claim 1, wherein the upper stop portion comprises an upper stop element which can be connected to the carrier element; and/or wherein the lower stop portion comprises a lower stop element which can be connected to the carrier element.

12. The fastening system as claimed in claim 11, wherein the stop element, which provides the displaceable stop portion, has a receptacle for the clamping element, and wherein, when the clamping element is actuated, the stop element can be displaced with the stop portion, in particular as a whole, relative to the carrier element.

13. The fastening system as claimed in claim 11, wherein the upper stop element is fixedly connected to the carrier element by way of a mechanical connection, wherein the mechanical connection is a latching connection or a snap-fit connection; or wherein the lower stop element is fixedly connected to the carrier element by way of a mechanical connection, and wherein the mechanical connection is a latching connection or a snap-fit connection.

14. The fastening system as claimed in claim 11, wherein the stop element, which provides the displaceable stop portion, has a receptacle for the clamping element, wherein, when the clamping element is actuated, the stop element can be displaced with the stop portion, in particular as a whole, relative to the carrier element, and wherein said stop element is mounted on a bar extension of the carrier element, said extension being oriented in the direction of actuation, wherein the clamping element preferably acts on an end surface which is arranged on the extension.

15. The fastening system as claimed in claim 1, wherein the carrier element comprises a crossmember portion and at least one support portion which projects from the crossmember portion, wherein a respective upper and a respective lower stop portion are present, and wherein the support portion and/or the crossmember portion have/has receiving structures for receiving functional elements.

16. An arrangement comprising a sanitary article having an upper stop and a lower stop, and a fastening system , said fastening system comprising a carrier element with at least one fastening receptacle which can be connected to a fastening means arranged in a fixed manner on site, at least one upper stop portion which lies on the carrier element and which strikes against an upper stop of the sanitary article, at least one lower stop portion which lies on the carrier element and which strikes against a lower stop of the sanitary article, and at least one clamping element, wherein, in the installation position, the upper stop portion lies above the lower stop portion, and wherein at least one of the stop portions is mounted on the carrier element so as to be displaceable with respect to the carrier element, and is connected to the at least one clamping element in such a way that, as a result of actuation of the clamping element, said stop portion can be displaced in a direction of actuation in such a way that the two stop portions can be braced between the two stops of the sanitary article.

17. The arrangement as claimed in claim 16, wherein the fastening system is arranged in a receiving space of the sanitary article; and/or wherein the sanitary article has an access opening, by way of which the clamping element is accessible with a tool or without a tool; and/or wherein the stops, with respect to the form thereof, are configured to have a complementary fit with the stop portions.

* * * * *